US006032475A

United States Patent [19]

Tolfsen

[11] Patent Number: 6,032,475

[45] Date of Patent: Mar. 7, 2000

[54] REFRIGERATION APPARATUS

[75] Inventor: Ulf Tolfsen, Gamle Fredrikstad, Norway

[73] Assignee: Norcool A.S., Norway

[21] Appl. No.: 09/051,498

[22] PCT Filed: Aug. 22, 1997

[86] PCT No.: PCT/NO97/00221

§ 371 Date: Apr. 13, 1998

§ 102(e) Date: Apr. 13, 1998

[87] PCT Pub. No.: WO98/07356

PCT Pub. Date: Feb. 26, 1998

[30] Foreign Application Priority Data

Aug. 23, 1996 [NO] Norway ..... 963516

[51] Int. Cl.[7] ..... A47F 3/04

[52] U.S. Cl. ..... 62/256; 62/458

[58] Field of Search ..... 62/256, 89, 458

[56] References Cited

U.S. PATENT DOCUMENTS

| | | | |
|---|---|---|---|
| 2,332,174 | 10/1943 | Shreve | 62/89.5 |
| 3,125,864 | 3/1964 | Ural | 62/256 |
| 3,128,609 | 4/1964 | Beckwith et al. | 62/256 |
| 3,134,243 | 5/1964 | Hagen et al. | 62/256 |
| 3,226,945 | 1/1966 | Spencer | 62/256 |
| 3,314,250 | 4/1967 | Weber | 62/256 |
| 3,501,925 | 3/1970 | Brennan et al. | 62/256 |
| 3,827,254 | 8/1974 | MacMaster et al. | 62/256 |
| 4,680,942 | 7/1987 | Kooy | 62/256 |
| 5,357,767 | 10/1994 | Roberts | 62/256 |
| 5,475,987 | 12/1995 | McGovern | 62/256 |

*Primary Examiner*—Henry Bennett
*Assistant Examiner*—Marc Norman
*Attorney, Agent, or Firm*—Austin R. Miller

[57] ABSTRACT

A refrigeration apparatus for cold merchandise, e.g., food products or containers holding beverages, particularly soft drinks, comprising a cabinet of a substantially rectangular shape in its horizontal cross section having an evaporator (8) and a fan (7) placed at the top within the cabinet (1), and a compressor (9), condenser (10) and fan (11) disposed at the bottom of the cabinet (1), and where a compartment (2) in the cabinet (1) for the beverage container (20) has a rear wall section (2"), a front wall section (16), a bottom section (2'), a top section (12), and side walls. The bottom section (2') has a curved, trough-like cross-sectional shape extending over the width of the compartment (2), and a return air channel (3) is provided in the width of the compartment (2) along the back side of the rear wall section (2") and the underside of the bottom section (2'), which channel has a primary suction aperture (4) at the forward edge (13) of the bottom section (2') and secondary suction apertures (6) in the surface of the bottom section (2'), as well as an outlet (4') in the top of the cabinet. The top section (12) has an opening (12') for blowing cooling air out from the evaporator (8)/fan (7) in the top of the cabinet and down into the compartment (2), and the front wall section (16) is pivotably attached to the front of the cabinet (1) and, in closed state, has a lower edge (16') situated in spaced relationship above and inside the forward edge (13) of the bottom section (2').

7 Claims, 3 Drawing Sheets

REFRIGERATION APPARATUS

Figure 1:
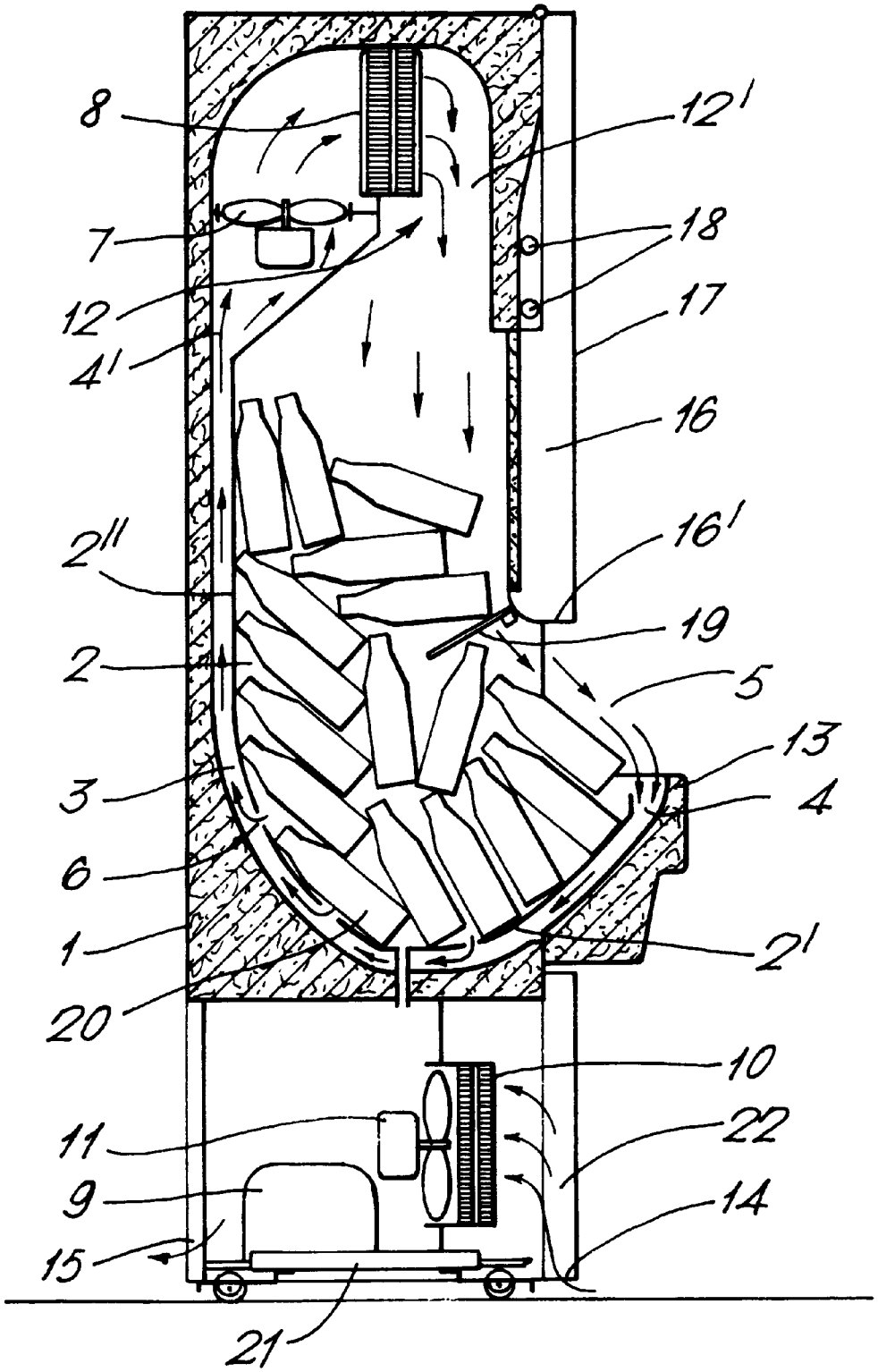

The present invention relates to a refrigeration apparatus for cold merchandise, e.g., food products or containers holding beverages, particularly soft drinks, comprising a cabinet of a substantially rectangular shape in its horizontal cross-section having an evaporator and a fan placed at the top within the cabinet, and a compressor, condenser and fan disposed at the bottom of the cabinet, and where a compartment in the cabinet for the cold merchandise has a rear wall section, a front wall section, a bottom section, a top section, and side walls.

There are known several types of refrigerating display counters or cabinets for use in the sales of beverages and other types of food products requiring refrigeration. The known types of refrigerators for this use can be divided into three main groups.

The first type comprises coolers designed as a cabinet having a door or doors in front, the door(s) often being made of glass or transparent plastic. The merchandise itself is placed on shelves inside the cabinet. The cooling aggregate is often placed in a separate compartment at the bottom or top of the cabinet. The cooling air is circulated by means of a fan inside the cabinet. Some of the disadvantages of these types of refrigerators are that they are time-consuming to fill due to the need for stacking the merchandise on the shelves, particularly if there is to be a proper turnover of the products ("first in, first out"). To achieve satisfactory exposure of the merchandise, it is necessary to have a bright light inside the cabinet, which light will produce some heat and increase the need for cooling. Also, it may seem more time-consuming for the customer, for it is necessary to open and close a door in order to remove the product. U.S. Pat. No. 4,977,754 is an example of this type of refrigerator.

The second main type of refrigerator is the so-called "well cooler." These coolers are containers which stand on the floor and are open at the top. The shape may vary from rectangular to round. The cooling aggregate is placed at the bottom, closest to the floor. The cooling air is circulated through the double side walls and bottom of the merchandise compartment. An advantage of this type is that it is simple for the customer to remove the products. The cooler is easy to fill, but if proper rotation of the merchandise is to be achieved ("first in, first out"), the older products must be removed prior to refilling, and then replaced at the top. The exposure of the merchandise itself is unsatisfactory, as it is not possible to see the actual product before the customer is standing right beside the cooler. The cooler has a large exposure surface open toward the room, and the merchandise situated at the top of the container will therefore be subject to considerably less effective refrigeration.

The third main group of refrigerators is of a relatively more recent date. These may be s formed like a very large bottle or a can in order to give a clear signal as to the contents of the cooler. Norwegian patent no. 178510 describes an example of this type. A characteristic of this cooler is that the merchandise compartment has an open zone all the way around the container where the goods are displayed and which is easily accessible to the customer. The cooling aggregate with an evaporator and fan is placed at the bottom of the cabinet. The cooling air is pressed up to the top of the merchandise compartment through a centrally disposed duct. At the bottom of the merchandise compartment are provided holes through which the air is sucked out and sent on through the evaporator, also at the bottom of the merchandise compartment. Refilling of the goods is done through the top of the merchandise compartment. The geometric similarity to a bottle renders the cooler relatively tall and narrow, but also means that the capacity (the number of bottles or cans) is relatively small, at the same time as the refilling area at the top is situated high up. The cooler affords ready access from all sides. This also means, however, that it requires considerable floor space and cannot be placed against a wall.

The present invention is intended to provide an apparatus which offers a high storage capacity for cold merchandise, e.g., food products or beverage containers, as well as a convenient way to load in new beverage containers, while also meeting the needs for effective cooling and for ease of operation for both purchasers of the merchandise and maintenance personnel.

The apparatus introduced above is, according to the invention, characterized in that the bottom section has a curved, trough-like cross-sectional shape extending over the width of the compartment, that a return air channel is provided in the width of the compartment along the back side of the rear wall section and the underside of the bottom section, which channel has a primary suction aperture at the forward edge of the bottom section and secondary suction Apertures in the surface of the bottom section, as well as an outlet in the top of the cabinet, that the top section has an opening for blowing cooling air out from the evaporator/fan in the top of the cabinet and down into the compartment, and that the front wall section is pivotably attached to the front of the cabinet and, in closed state, has a lower edge situated in spaced relationship above and inside the forward edge of the bottom section.

According to additional embodiment forms of the apparatus, the bottom section has a rear part having a first radius of curvature, and a front part having a second, larger radius of curvature. Optionally an intermediate, approximately flat portion may be provided between the first part and the second part.

Within the compartment inside the lower edge of the front wall section there is advantageously provided a slanted baffle plate for cold goods, extending downwards and inwards into the compartment over a portion of the depth and across the entire width thereof.

Figure 2:
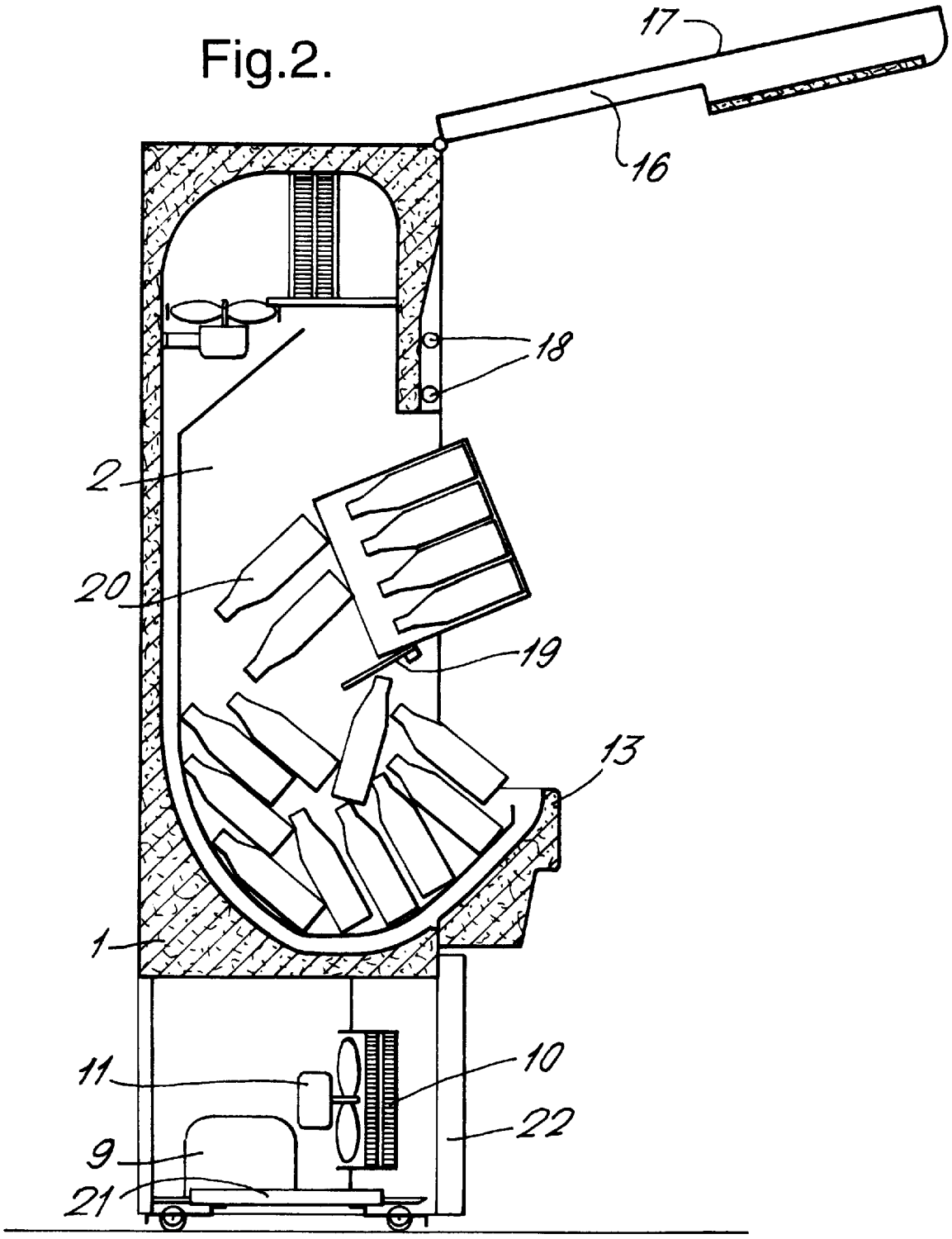
Figure 3:
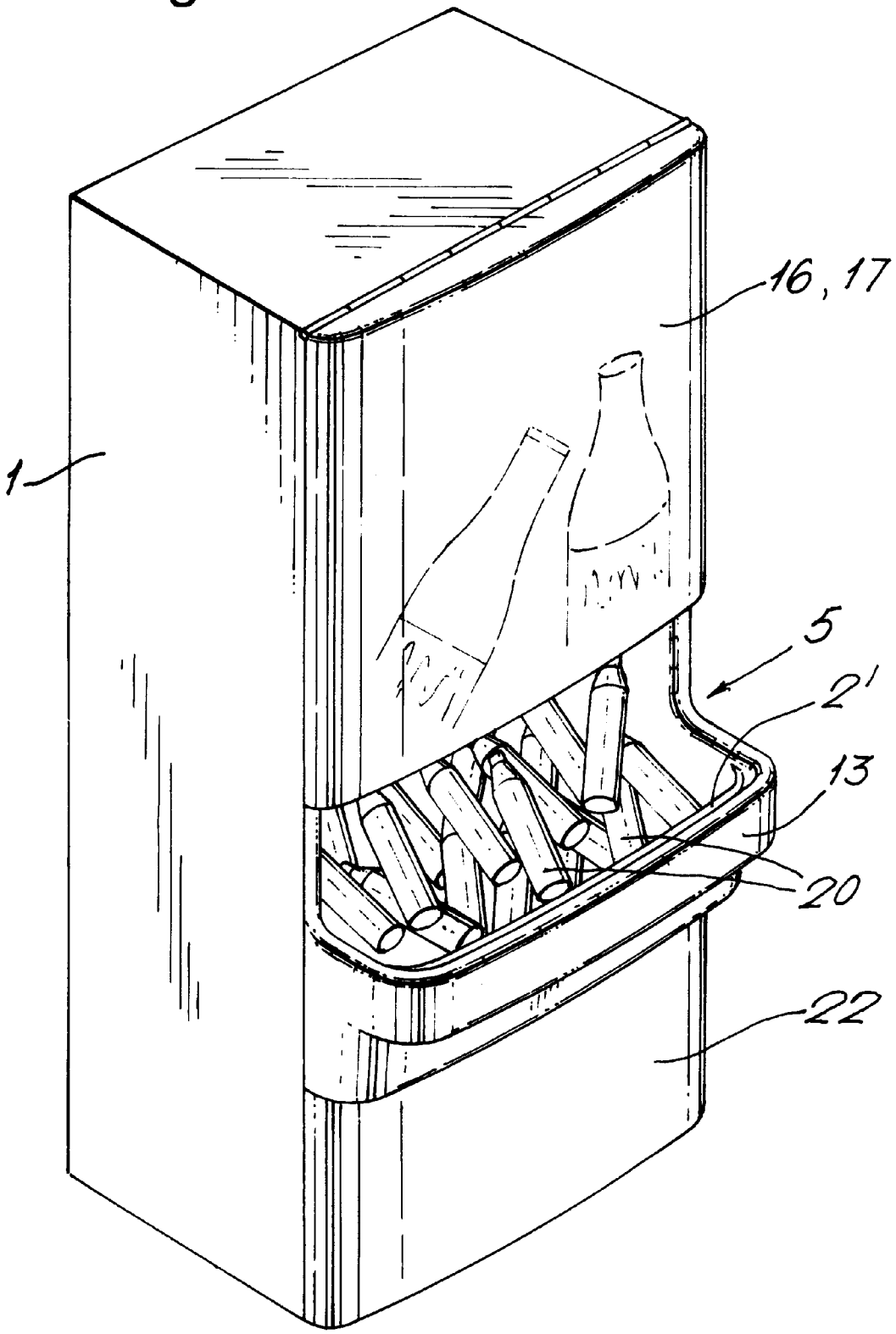

The invention will now be described in more detail with reference to the accompanying figures, where:

FIG. 1 is a vertical cross-sectional view through the apparatus, according to the invention, FIG. 2 is a vertical cross-sectional view through the apparatus according to FIG. 1 during refilling of new cold merchandise, and FIG. 3 is a perspective, frontal view of a refrigerating cabinet, according to the invention.

In the following description the cold goods are exemplified by beverage containers, although other types of refrigerated merchandise are conceivable within the scope of the invention, such as food products with or without packaging containers.

The actual cabinet 1 has a rectangular shape and a size corresponding to the type of refrigerator. The internal container or compartment 2 for merchandise, such as beverage containers, has an air channel 3 across the entire interior width of the compartment. This channel has a slot 4 which sucks in air at the front of the grasping zone 5. This contributes toward the prevention of loss of cold air in the grasping zone 5. In addition there are provided apertures or transverse slots 6 in the bottom section 2' and, optionally, in portions of the rear wall section 2" of the compartment. The air channel 3 terminates at the top, where there is provided at least one fan which forces the air further through an evaporator 8 placed at the very top of internal container 2.

Compressor 9 and condenser 10 together with fan 11 for the condenser are placed at the bottom of the cabinet. The entire cooling aggregate is situated on a plate 21 which, during maintenance of the aggregate, may be pulled out through the front by first removing a lower front cover 22. Cold air to the condenser 10 is drawn in through a slot 14 down near the floor in front of the cabinet. This heated air passes out through a slot 15 at the rear edge of the cabinet.

The entire upper part of the front above the grasping zone consists of a front wall section in the form of a front cover 16 having a transparent plastic panel 17 with a printed impression in front. To achieve a better quality and attract greater attention this panel is illuminated on the back side thereof by means of light sources 18. Light source 18 may be attached directly to the cabinet, thus eliminating any difficulties with cabling to the movable front cover. To avoid infusion of heat from the light sources, the wall behind the light source and the back side of the front cover are insulated. In addition, front cover 16 is ventilated at the top and bottom thereof to release the heat from the light sources.

To refill the cabinet with merchandise 20, such as beverage containers 20, e.g., bottles or cans, front cover 16 is opened, as indicated on FIG. 2. Front cover 16 is hinged at the upper edge and held in open position by gas dampers or a bar (not shown). A baffle plate 19 may be used as a support surface for cases or transport packaging when refilling. Baffle plate 19 will also ensure that beverage containers which are moving downwards in compartment 2 are guided slightly inwards in the compartment. The bottom section of compartment 2 is designed such that the merchandise still remaining in compartment 2 is urged forward towards grasping zone 5 when new merchandise is refilled from the top. For this purpose, bottom section 2' is provided with a rear part having a first radius of curvature and a front part having a second surface area of greater radius of curvature, and an almost flat portion between said front and rear parts. This provides for a proper circulation of the merchandise, i.e., "first in, first out." Baffle plate 18 is optionally removable for cleaning, or for emptying the container or filling it for the first time. This is particularly important with regard to delicate packaging which may be damaged on filling, such as, e.g., soft drink or beer cans, cardboard packages, etc.

Tests have shown that having the evaporator 8 and fan 7 placed at the top of the cooling unit, having the channel for return air extend along the entire width of the compartment, having channel 3 terminate in slot 4 at the front edge 13 of grasping zone 5 and in addition, providing the aforementioned transverse slots 6 in the channel in the bottom section and the lower part of the back section, results in very effective circulation and distribution of the cooling air. Slot 4 combined with baffle plate 19, the depth of grasping zone 5 and the proper configuration of the front edge of grasping zone 5, all serve to reduce the loss of cooling air in this section.

Because it is possible to open up the entire front cover 16, the cooler may be filled quickly and easily. Entire cases or packaging units can be emptied directly into the merchandise compartment. The loading height is ergonomically correct.

The design of the bottom is such that when merchandise is filled at the top, the older merchandise will be urged forward towards grasping zone 5. This ensures a proper circulation of the goods (i.e., "first in, first out").

The rectangular shape of the refrigerating cabinet provides for large capacity in relation to floor space. The cooler may be placed against a wall, optionally in combination with traditional cabinets with doors, or free-standing either individually or in a group. It is also possible to consider equipping the cooling compartment 2 with, e.g., one or two vertical partition walls so that the cooler can be used for several different types of merchandise simultaneously.

Front cover 16 has space for profiling the trademark or logo of the sales merchandise 17, e.g., in the form of a picture or relief/image (3D). The light source 18, which provides for the background illumination, is insulated from the actual cooler so that no unnecessary heat is introduced into the cold zone (the compartment).

I claim:

1. A refrigeration apparatus for cold merchandise, e.g., food products or containers holding beverages, particularly soft drinks, comprising a cabinet of a substantially rectangular shape in its horizontal cross-section having an evaporator and a fan placed at the top within the cabinet, and a compressor, condenser and fan disposed at the bottom of the cabinet, and where a compartment in the cabinet for the beverage container has a rear wall section, a front wall section, a bottom section, a top section, and side walls, characterized in that the bottom section has a curved trough-like cross-sectional shape extending over the width of the compartment, said bottom section extending continuously from back to front, sloping down at the back and up to the front to move said food products or containers in a first-in first-out direction in response to forces exerted downwardly by newly inserted food products or containers, and wherein a return air channel is provided in the width of the compartment along the back side of the rear wall section and the underside of the bottom section, which channel has a primary suction aperture at the forward edge of the bottom section and secondary suction apertures in the surface of the bottom section, as well as an outlet in the top of the cabinet, wherein the top section has an opening for blowing cooling air out from the evaporator fan in the top of the cabinet and down into the compartment, and wherein the front wall section is pivotally attached to the front of the cabinet and, in closed state, has a lower edge situated in spaced relationship above and inside the forward edge of the bottom section.

2. An apparatus as disclosed in claim 1, characterized in that said bottom section has a rear part having a first radius of curvature and a front part having a second, greater radius of curvature.

3. An apparatus as disclosed in claim 2, characterized by an intermediate, approximately flat portion between said first part and said second part.

4. An apparatus as disclosed in claim 1, characterized in that within the compartment inside the lower edge of the front wall section is provided a slanted baffle plate for cold goods, extending downwards and inwards into said compartment over a portion of the depth and across the entire width thereof.

5. A refrigeration apparatus for cold merchandise including food products or containers holding beverages, particularly soft drinks, comprising a cabinet of a substantially rectangular shape and its horizontal cross-section having an evaporator and a fan placed at the top within the cabinet, and a compressor, condenser and fan disposed at the bottom of the cabinet, and where a compartment in the cabinet for the beverage container has a rear wall section, a front wall section, a bottom section, a top section, and sidewalls, characterized in that the bottom section has a curved troughlike cross-sectional shape extending over the width of the compartment, and wherein a return air channel is provided in the width of the compartment along the backside of the rear wall section and the underside of the bottom section, which channel has a primary suction aperture at the forward edge and secondary suction apertures in the surface of the bottom section, as well as an outlet in the top of the cabinet, wherein the top section has an opening for blowing cooling air out from the evaporator fan in the top of the cabinet and down into the compartment, and wherein the front wall section is pivotally attached to the front of the cabinet and, in closed state, has a lower edge situated in space relationship above and inside the forward edge of the bottom section, wherein, within the compartment inside the lower edge of the front wall section, a slanted baffle plate is provided for cold goods, extending downward and inward into said compartment over a portion of the depth and across the entire width thereof.

6. An apparatus as disclosed in claim 5, characterized in that said bottom section has a rear part having a first radius of curvature and a front part having a second, greater radius of curvature.

7. An apparatus as disclosed in claim 5, characterized by an intermediate, approximately flat portion between said first part and said second part.

* * * * *